US007056138B2

(12) United States Patent
Lewis et al.

(10) Patent No.: US 7,056,138 B2
(45) Date of Patent: Jun. 6, 2006

(54) RETAINING CLIP FOR ANDERSON-TYPE POWER CONNECTORS

(75) Inventors: Mark Eugene Lewis, Yountville, CA (US); Christopher Michael Hankins, Santa Rosa, CA (US); Jeffrey L. Wilson, Santa Rosa, CA (US)

(73) Assignee: Tellabs Petaluma, Inc., Petaluma, CA (US)

( * ) Notice: Subject to any disclaimer, the term of this patent is extended or adjusted under 35 U.S.C. 154(b) by 0 days.

(21) Appl. No.: 10/913,871

(22) Filed: Aug. 5, 2004

(65) Prior Publication Data

US 2006/0035501 A1 Feb. 16, 2006

(51) Int. Cl.
*H01R 13/62* (2006.01)

(52) U.S. Cl. ..... 439/296; 174/135; 439/345

(58) Field of Classification Search ..... 439/292, 439/299, 345, 347, 369; 174/135; 385/135
See application file for complete search history.

(56) References Cited

U.S. PATENT DOCUMENTS 4,932,890 A * 6/1990 Cheng ..... 439/367
5,131,851 A * 7/1992 Billger et al. ..... 439/34
5,166,995 A * 11/1992 Briggs et al. ..... 385/58
5,183,971 A * 2/1993 Lafosse et al. ..... 174/138 F
5,834,694 A * 11/1998 Bakker et al. ..... 174/65 G
6,088,981 A * 7/2000 Edwards ..... 52/239
6,528,728 B1 * 3/2003 Shima ..... 174/101
6,669,375 B1 * 12/2003 Bonja et al. ..... 385/73
6,761,568 B1 * 7/2004 Bakker et al. ..... 439/140
6,923,685 B1 * 8/2005 Holmes et al. ..... 439/660

FOREIGN PATENT DOCUMENTS

JP 01294382 A * 11/1989
JP 01294383 A * 11/1989

OTHER PUBLICATIONS

Catalog No. 110G12 BLOK LOK For 4 POLE PP10/45, Anderson Power Products, [online], [retrieved on Oct. 19, 2004]. Retrieved from the Internet: <URL:http://www.andersonpower.com/products/pdf/114194s2.pdf>. p. 1 of 1.
Catalog No. 110G21 BLOK LOK For 2 POLE PP10/45, Anderson Power Products, [online], [retrieved on Oct. 19, 2004]. Retrieved from the Internet: <URL:http://www.andersonpower.com/products/pdf/114194s1.pdf>, p. 1 of 1.
Anderson Power Poducts, Mounting Clamps for PP75-PP180, [online], [retrieved on Jul. 28, 2004]. Retrieved from the Internet:<URL:http://www.andersonpower.com/products/pdf/114207s1.pdf>. Sheet 1 of 1.

* cited by examiner

*Primary Examiner*—Michael C. Zarroli
(74) *Attorney, Agent, or Firm*—Mark C. Pickering

(57) ABSTRACT

When a first pair of power connectors are inserted into a second pair of power connectors, the connectors are prevented from electrically and physically separating by a retaining clip that fits into the locking opening between the first pair of power connectors, and the locking opening between the second pair of power connectors.

24 Claims, 4 Drawing Sheets

RETAINING CLIP FOR ANDERSON-TYPE POWER CONNECTORS

BACKGROUND OF THE INVENTION

1. Field of the Invention

The present invention relates to power connectors and, more particularly, to a retaining clip for power connectors.

2. Description of the Related Art

A power connector is a device that provides a connecting interface to a power wire, such as a #14 power wire, to allow easy connections to be made to other wires to form a continuous electrical pathway. A power connector can be used, for example, to connect a printed circuit board to a power source, or a power source, such as a battery, to a wiring harness.

FIG. 1 shows a cross-sectional view that illustrates a prior-art power connector 100. Power connector 100 is an example of a type of connector manufactured by, for example, Anderson Power Products®, Sterling, Mass. As shown in FIG. 1, power connector 100 includes a non-conductive housing 110, and a crimping mechanism 112 held by the housing 110 that receives and electrically contacts a wire 114.

Connector 100 also includes a terminal 116 that electrically contacts the crimping mechanism 112, and a spring 118 that locks the terminal 116 in place. During insertion, the wire 114 pushes the terminal 116 in the direction A until the terminal 116 is forced over the end of the spring 118.

FIG. 2 shows a perspective view that illustrates a side-by-side pair of prior-art power connectors 100. As shown in FIG. 2, power connectors 100 are typically used in side-by-side pairs where one connector, the red connector, carries, for example, 13.8V, while the other connector, the black connector, provides a ground path.

In addition, the housing 110 of each power connector 100 is identically formed, and includes a tongue and groove system, such as groove 122. Further, once the tongue of one connector 100 is inserted into the groove of a second connector 100, a roll pin 124 can be inserted into a locking opening 126 to physically lock the two connectors 100 side-by-side (the two connectors are not electrically connected together).

One problem with power connectors is that, although a locking pin, such as pin 124, can be utilized to lock two connectors 100 side-by-side, no such locking mechanism exists that keeps two pairs of power connectors electrically connected together.

For example, when a first pair of power connectors are inserted into, and electrically connected to, a second pair of power connectors to provide, for example, a power and ground path to a printed circuit board, there is no locking mechanism that keeps the first and second pairs of power connectors electrically connected together.

When power connectors are electrically connected together, the connectors are physically held together by the force resistance of the terminals and springs of the connectors, such as the upward force resistance of terminal 116 against spring 118 of the power connector 100 shown in FIG. 1.

In actual practice, the force resistance of the terminals and springs is typically sufficient to maintain a tight connection. However, in some instances, the terminals and springs of the connectors 100 fail to maintain sufficient resistance which, in turn, can cause the pair of connectors 100 to electrically disconnect and physically come apart.

One approach to preventing power connectors from electrically and physically coming apart is to mount the connectors to a surface, such as a printed circuit board (PCB) or a bulkhead. For example the connectors can be connected to a bulkhead opening using, for example, mounting clamps or plastic cable ties. By mounting the connectors to a surface, the connectors 100 can not come apart.

However, a mounting surface is not always available. Thus, there is a need for an approach that prevents power connectors from physically coming apart, once the connectors have been inserted together to form an electrical connection, that does not require that the connectors be mounted to a surface.

BRIEF DESCRIPTION OF THE DRAWINGS

FIG. 3A is a bottom side perspective view, while FIG. 3B is a top side perspective view.

FIG. 4A is a top side perspective view, while FIG. 4B is a bottom side perspective view.

FIG. 5A is a side view, while FIG. 5B is an end view.

DETAILED DESCRIPTION OF THE INVENTION

Figure 1:
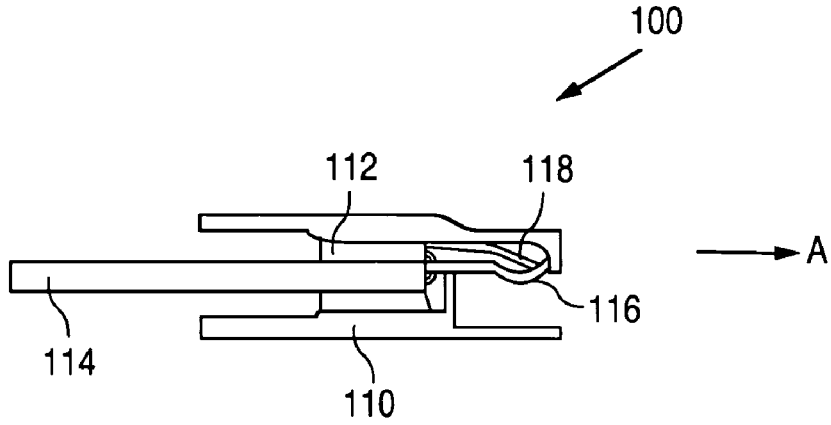
FIG. 1 (PRIOR ART)
FIG. 1 is a cross-sectional view illustrating a prior-art power connector 100.
Figure 2:
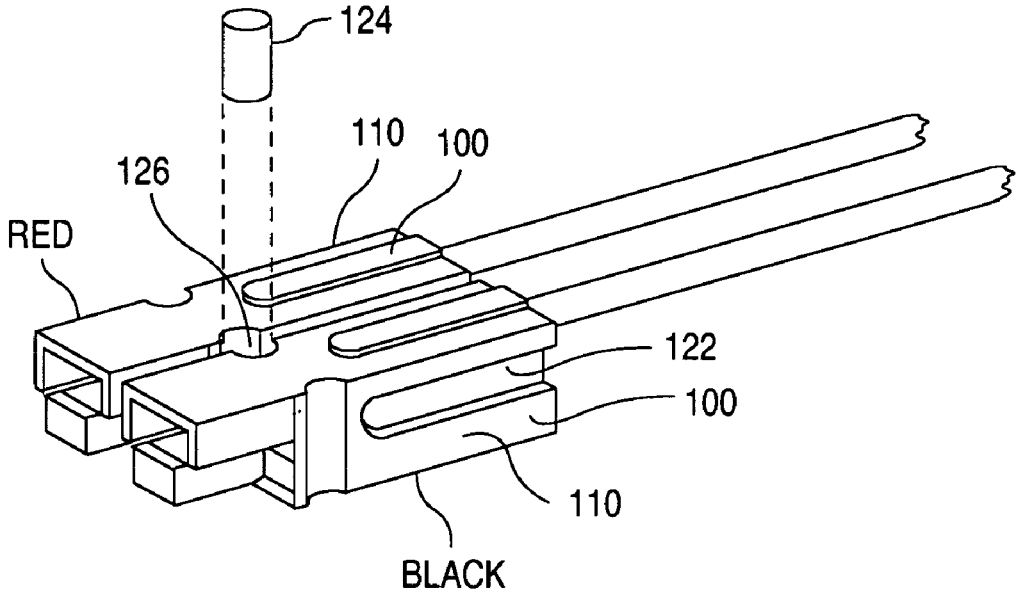
FIG. 2 (PRIOR ART)
FIG. 2 is a perspective view illustrating a side-by-side pair of prior-art power connectors 100.
Figure 3A:
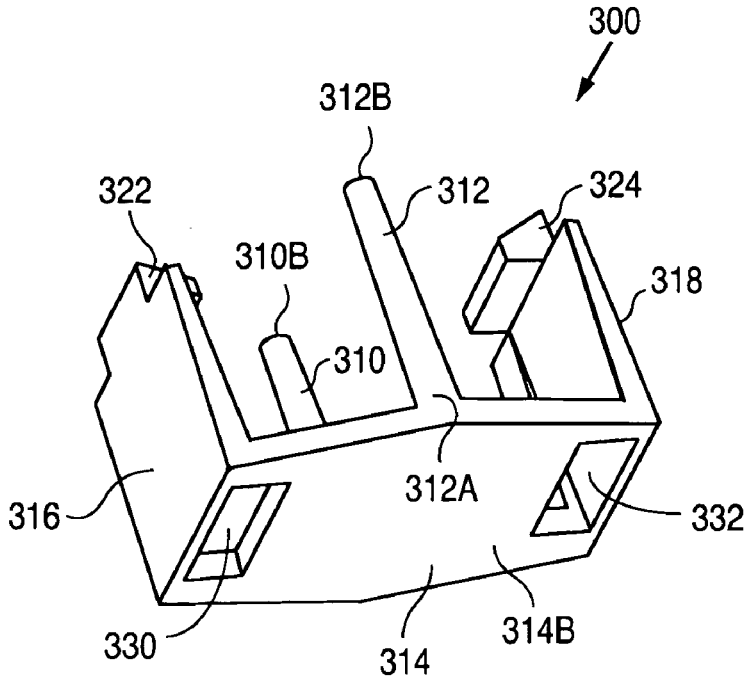
FIGS. 3A and 3B are views illustrating an example of a power connector retaining clip 300 in accordance with the present invention.
Figure 3B:
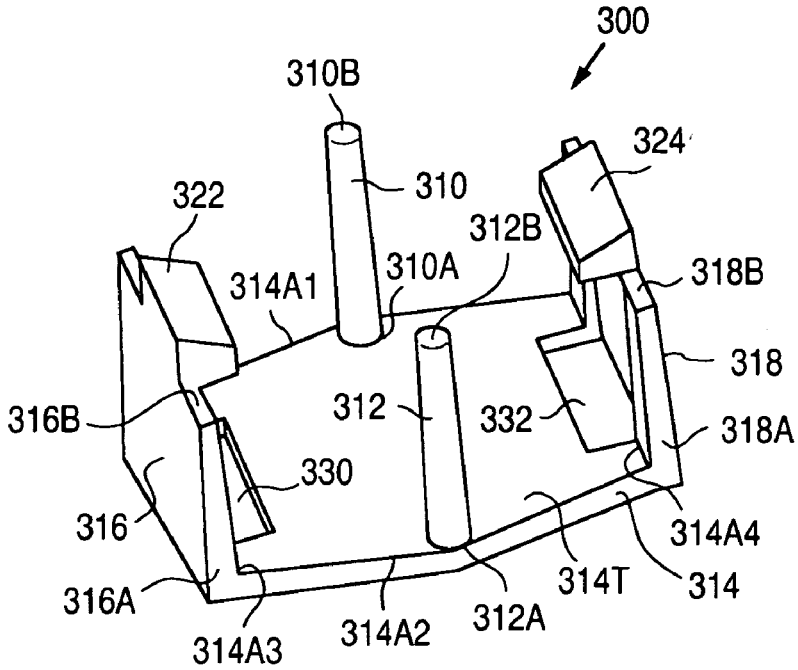

FIGS. 3A and 3B show views that illustrate an example of a power connector retaining clip 300 in accordance with the present invention. FIG. 3A shows a bottom side perspective view, while FIG. 3B shows a top side perspective view. As described in greater detail below, retaining clip 300 provides an inexpensive and easy to use approach to insuring that once a number of power connectors are electrically connected together, the connectors remain physically connected together.

As shown in FIGS. 3A and 3B, retaining clip 300 includes a first rod 310 that has a bottom end 310A and a spaced-apart top end 310B, and a second rod 312 that has a bottom end 312A and a spaced-apart top end 312B. In addition, retaining clip 300 has a base region 314 that has a top surface 314T and a bottom surface 314B, where the top surface 314T contacts the bottom ends 310A and 312A of the first and second rods 310 and 312. The first and second rods 310 and 312 are also spaced apart, and lie substantially parallel to each other.

As further shown in FIG. 3B, the top surface 314T of the base region 314 has a first side 314A1, a second side 314A2 that is located opposite to and spaced apart from the first side 314A1, a third side 314A3 that is connected to the first and second sides 314A1 and 314A2, and a fourth side 314A4 that is connected to the first and second sides 314A1 and 314A2 and is located opposite to the third side 314A3.

In addition, the first rod 310 is located adjacent to an intermediate position along a length of the first side 314A1 (at the bend in the FIGS. 3A–3B example), while the second rod 312 is located adjacent to an intermediate position along a length of the second side 314A2.

Retaining clip 300 also includes a first side wall 316 that has a bottom end 316A and a top end 316B, and a second side wall 318 that has a bottom end 318A and a top end 318B. Further, the bottom ends 316A and 318A of the first and second side walls 316 and 318 contact the third and fourth sides 314A3 and 314A4, respectively.

In addition, retaining clip 300 includes a first tab 322 that contacts and extends away from the top end 316B of the first side wall 316, and a second tab 324 that contacts and extends away from the top end 318B of the second side wall 318. Tabs 322 and 324 extend towards each other.

In the present invention, the base region 314, the first and second side walls 316 and 318, and the tabs 322 and 324 form a retaining enclosure. The first and second side walls 316 and 318 are non-normal to the top surface 314T of the base region 314, and lean towards the top surface 314T of the base region 314 to provide a retaining force when the side walls 316 and 318 are forced to be more normal to the top surface 314T.

As additionally shown in the FIGS. 3A and 3B example, the base region 314 has a first opening 330 that is located adjacent to the third side 314A3. The base region 314 also has a second opening 332 that is located adjacent to the fourth side 314A4. In the present example, the first and second openings 330 extend from the top surface 314T through to the bottom surface 314B.

Figure 4A:
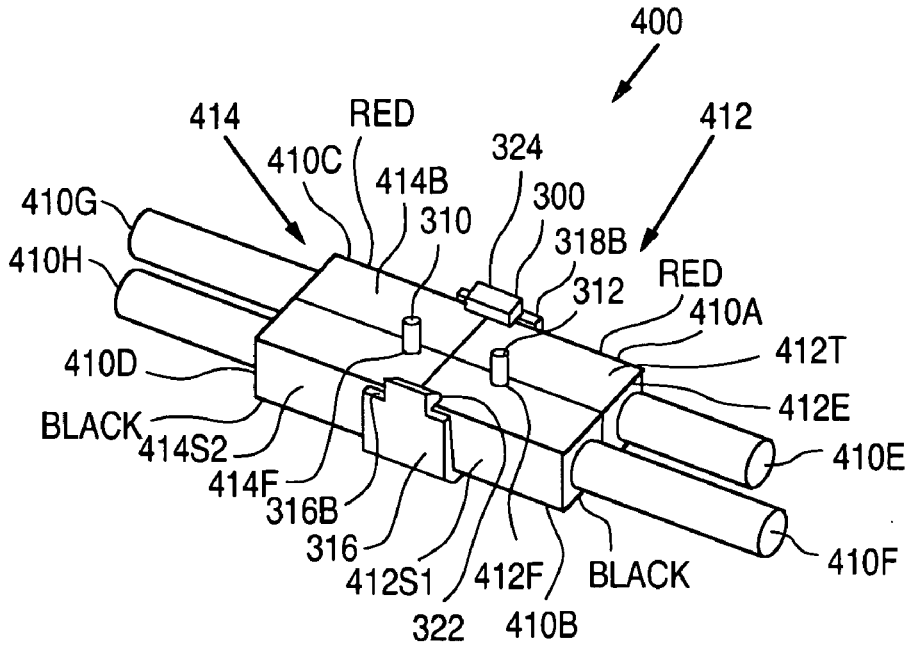
FIGS. 4A and 4B are views illustrating an example of a power connection 400 in accordance with the present invention.
Figure 4B:
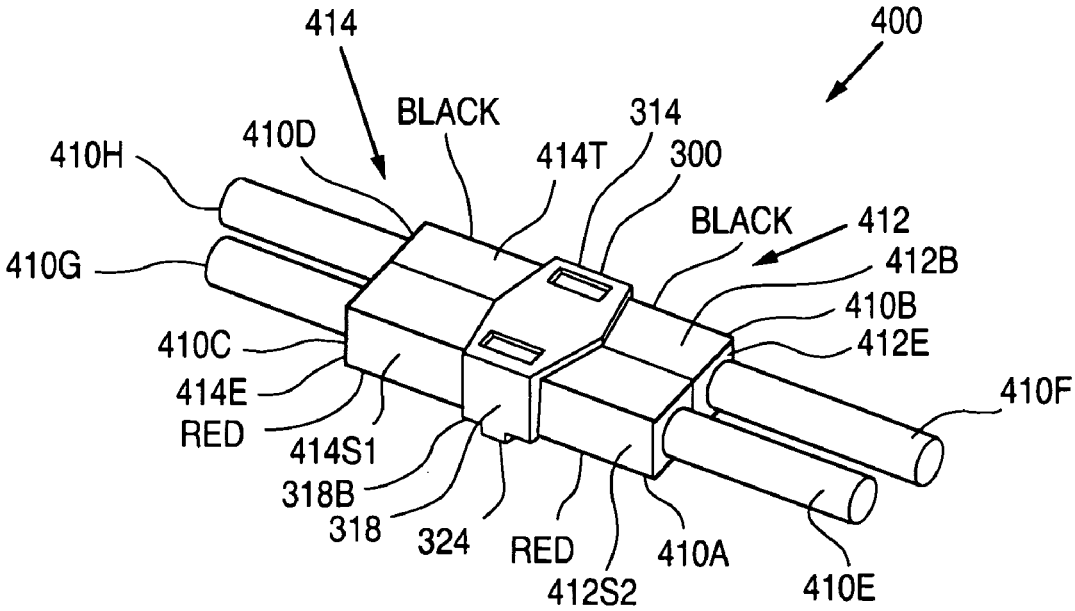

FIGS. 4A and 4B show views that illustrate an example of a power connection 400 in accordance with the present invention. FIG. 4A shows a top side perspective view, while FIG. 4B shows a bottom side perspective view. As shown in FIGS. 4A and 4B, connection 400 includes four power connectors 410A, 410B, 410C, and 410D that are connected to four wires 410E, 410F, 410G, and 410H, respectively. Two of the connectors 410A and 410C carry power, and two of the connectors 410B and 410D carry ground. In addition, each of the connectors 410A, 410B, 410C, and 410D can be implemented using power connector 100.

As further shown in FIGS. 4A and 4B, connectors 410A and 410B are connected together via the tongue and groove structures to form a first connector pair 412 that has a top surface 412T, a bottom surface 412B, a first side wall 412S1, a second side wall 412S2 that opposes side wall 414S1, an end wall surface 412E, and a first opening 412F that extends from the top surface 412T to the bottom surface 412B.

Connectors 410C and 410D are also connected together via the tongue and groove structures to form a second connector pair 414 that has a top surface 414T, a bottom surface 414B, a first side wall 41451, a second side wall 41452 that opposes side wall 41451, an end wall surface 414E, and a second opening 414F that extends from the top surface 414T to the bottom surface 414B.

As additionally shown in FIGS. 4A and 4B, connection 400 includes a retaining clip 300 that is attached to the first and second connector pairs 412 and 414 so that the first and second rods 310 and 312 are inserted into the first and second openings 412F and 414F. In addition, the base region 314 of retaining clip 300 contacts or lies adjacent to a portion of the bottom surface 412B of the first connector pair 412 and a portion of the top surface 414T of the second connector pair 414.

Further, the first side wall 316 contacts the first side wall 412S1 of the first connector pair 412, and the second side wall 414S2 of the second connector pair 414, while the second side wall 318 contacts the second side wall 412S2 of the first connector pair 412, and the first side wall 414S1 of the second connector pair 414.

Figure 5A:
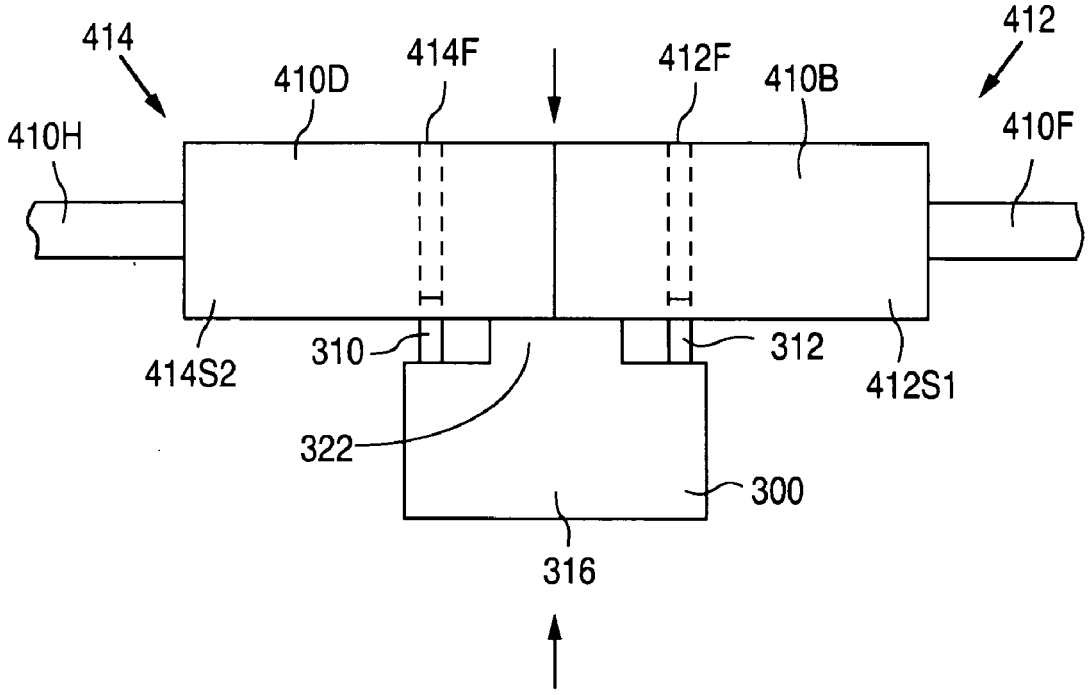
FIGS. 5A and 5B are views illustrating the use of retaining clip 300 in accordance with the present invention.
Figure 5B:
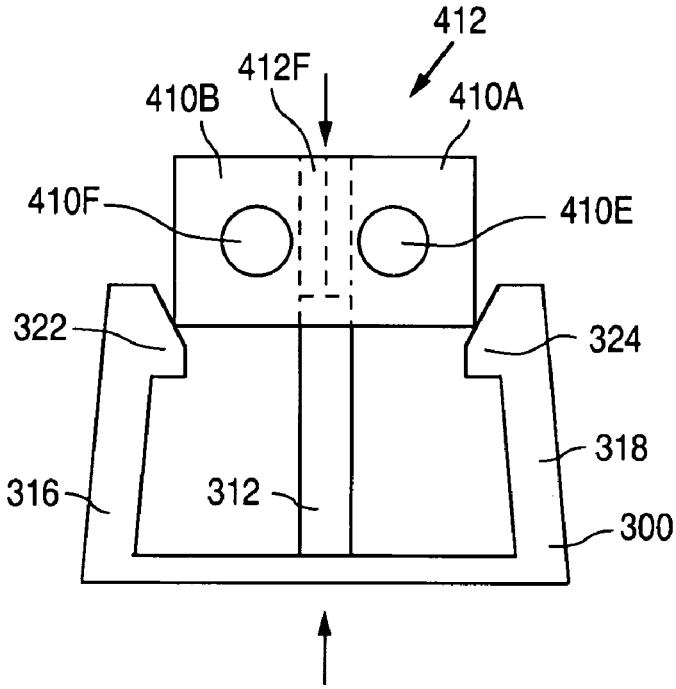

FIGS. 5A and 5B show views that illustrate the use of retaining clip 300 in accordance with the present invention. FIG. 5A shows a side view, while FIG. 5B shows an end view. To perform an installation that includes a first pair of power connectors, such as first connector pair 412, and a second pair of power connectors, such as second connector pair 414, the first step is to connect together the two pair of connectors, such as connecting together connector pairs 412 and 414.

Following this, as shown in FIGS. 5A and 5B, the next step is to place retaining clip 300 over the junction between pairs 412 and 414 so that the first and second rods 310 and 312 partially extend into the openings 414F and 412F, respectively, of the two pairs of power connectors 414 and 412, respectively.

Following this, external forces are applied to retaining clip 300 and pairs 412 and 414 as shown by the arrows. The external forces, which can be applied by an installer's hand, cause side walls 316 and 318 to deform outwards until pairs 412 and 414 snap into place where the first and second rods 310 and 312 extend completely through openings 414F and 412F, respectively, and top surface 314T of base region 314 contacts or lies adjacent to pairs 412 and 414.

Once the pairs 412 and 414 have snapped into place, the side walls 316 and 318 attempt to return to the prior non-deformed positions and, in the process, exert a retaining pressure on the two pairs of power connectors, while the tabs 322 and 324 and the base region 314 complete the enclosure. Once inserted, the first and second rods 310 and 312 prevent any longitudinal movement of connector pairs 412 and 414.

Thus, in addition to providing a secure connection, retaining clip 300 of the present invention is also easy to install. In the present invention, retaining clip 300 provides self-alignment in that once the first and second rods 310 and 312 have been partially inserted into the openings 412F and 414F, which is an easily detected condition, the only remaining step is to snap the pieces together. Further, retaining clip 300 can be removed by simply pulling apart the top ends 316B and 318B, which can easily be accomplished with an installer's fingers.

Retaining clip 300 can also be formed as a single structure from a flexible material such as molded plastic. As a result, retaining clip 300 can be inexpensively produced and, as described above, easily installed. Thus, the present invention provides an inexpensive and easy to use approach to insuring that once a number of power connectors are electrically connected together, the connectors remain physically connected together.

It should be understood that the above descriptions are examples of the present invention, and that various alternatives of the invention described herein may be employed in practicing the invention. For example, an identical structure can be formed on both sides of base region 314 to securely hold together additional connectors. Thus, it is intended that the following claims define the scope of the invention and that structures and methods within the scope of these claims and their equivalents be covered thereby.

What is claimed is:

1. A retaining clip comprising:

a base region having a top surface and a bottom surface, the top surface having opposing first and second edges, and opposing third and fourth edges that contact the first and second edges;

a first member having a first end connected to the top surface adjacent to the first edge, and a spaced-apart second end with a first tab that extends away from the second end of the first member;

a second member having a first end connected to the top surface adjacent to the second edge, and a spaced-apart second end with a second tab that extends away from the second end of the second member, the first and second tabs extending towards each other;

a first rod having a first end connected to the top surface, and a spaced-apart second end; and a second rod having a first end connected to the top surface, and a spaced-apart second end, the first rod lying closer to the third edge than the second rod, the second rod lying closer to the fourth edge than the first rod.

2. The retaining clip of claim 1 wherein the first and second members lean towards the top surface of the base region.

3. The retaining clip of claim 1 wherein the second end of the first rod is rounded, and the second end of the second rod is rounded.

4. The retaining clip of claim 1 and further comprising a first opening formed in the base region adjacent to the first side, and a second opening formed in the base region adjacent to the second side.

5. The retaining clip of claim 4 wherein the first and second openings extend through the base region from the top surface to the bottom surface.

6. The retaining clip of claim 1 wherein the first end of the first member contacts the first edge, and the first end of the second member contacts the second edge.

7. The retaining clip of claim 6 wherein the first end of the first rod contacts the third edge, and the first end of the second rod contacts the fourth edge.

8. The retaining clip of claim 6 wherein the first end of the first rod contacts a middle point along the third edge, and the first end of the second rod contacts a middle point along the fourth edge.

9. A power connection comprising:

four identical power connectors, each power connector having a first side wall with a groove and an opposing second side wall with a tongue, the power connectors including:

a first power connector to receive a first wire;

a second power connector to receive a second wire, the tongue of the second power connector contacting the groove of the first power connector to define a first opening, the first and second wires being electrically isolated;

a third power connector to receive a third wire, the first and third wires being electrically connected together; and a fourth power connector to receive a fourth wire, the tongue of the fourth power connector contacting the groove of the third power connector to define a second opening, the second and fourth wires being electrically connected together, and the third and fourth wires being electrically isolated; and a retaining clip having:

a base region having a top surface and a bottom surface, the top surface having opposing first and second edges, and opposing third and fourth edges that contact the first and second edges;

a first member connected to the top surface adjacent to the first edge, the first member contacting the second side wall of the first power connector, and the second side wall of the third power connector;

a second member connected to the top surface adjacent to the second edge, the second member contacting the first side wall of the second power connector, and the first side wall of the fourth power connector;

a first rod connected to the top surface, and lying in the first opening; and a second rod connected to the top surface, and lying in the second opening.

10. The power connection of claim 9 wherein the base region lies adjacent to a bottom surface of each of the first and second power connectors, and a top surface of each of the third and fourth power connectors.

11. The power connection of claim 9 wherein:

the first member has a tab that extends over a top surface of the first power connector, and a bottom surface of the third power connector; and the second member has a tab that extends over a top surface of the second power connector, and a bottom surface of the fourth power connector.

12. The power connection of claim 11 wherein the first and second members lean towards the top surface of the base region.

13. A method of providing power comprising:

inserting a first power connector into a second power connector, the first power connector having a first side wall with a groove and an opposing second side wall with a tongue, the second power connector having a first side wall with a groove and an opposing second side wall with a tongue;

inserting a third power connector into a fourth power connector, the third power connector having a first side wall with a groove and an opposing second side wall with a tongue, the fourth power connector having a first side wall with a groove and an opposing second side wall with a tongue;

inserting the tongue of the first power connector into the groove of the third power connector, and the tongue of the fourth power connector into the groove of the third power connector to form a first opening and a second opening;

connecting a retaining clip to a plurality of power connectors, the plurality of power connectors including the first and second power connectors, the retaining clip having:

a base region having a top surface and a bottom surface, the top surface having opposing first and second edges, and opposing third and fourth edges that contact the first and second edges;

a first member connected to the top surface adjacent to the first edge, the first member contacting the first side wall of the first power connector, and the first side wall of the second power connector;

a second member connected to the top surface adjacent to the second edge;

a first rod connected to the top surface, and lying in the first opening; and a second rod connected to the top surface, and lying in the second opening.

14. The method of claim 13 wherein the base region lies adjacent to a bottom surface of each of the first and third power connectors, and a top surface of each of the second and fourth power connectors.

15. The method of claim 13 wherein the first member has a tab that extends over a top surface of the first power connector, and a bottom surface of the second power connector.

16. The method of claim 15 wherein:

the second member contacts the second side wall of the third power connector, and the second side wall of the fourth power connector; and the second member has a tab that extends over a top surface of the third power connector, and a bottom surface of the fourth power connector.

17. The method of claim 13 wherein the first and second members lean towards the top surface of the base region.

18. The method of claim 17 wherein the second member contacts the second side wall of the third power connector, and the second side wall of the fourth power connector.

19. A method of providing power comprising:

inserting a first power connector into a second power connector, the first power connector having a first side wall with a groove and an opposing second side wall with a tongue, the second power connector having a first side wall with a groove and an opposing second side wall with a tongue, the tongue of the first power connector contacting the groove of the second power connector to form a first opening;

inserting a third power connector into a fourth power connector, the third power connector having a first side wall with a groove and an opposing second side wall with a tongue, the fourth power connector having a first side wall with a groove and an opposing second side wall with a tongue, the tongue of the third power connector contacting the groove of the fourth power connector to form a second opening;

inserting the first power connector into the third power connector;

inserting the second power connector into the fourth power connector;

connecting a retaining clip to a plurality of power connectors, the plurality of power connectors including the first and third power connectors, the retaining clip having:

a base region having a top surface and a bottom surface, the top surface having opposing first and second edges, and opposing third and fourth edges that contact the first and second edges;

a first member connected to the top surface adjacent to the first edge, the first member contacting the first side wall of the first power connector, and the first side wall of the third power connector;

a second member connected to the top surface adjacent to the second edge;

a first rod connected to the top surface, and lying in the first opening; and a second rod connected to the top surface, and lying in the second opening.

20. The method of claim 19 wherein the base region lies adjacent to a bottom surface of each of the first and second power connectors, and a top surface of each of the third and fourth power connectors.

21. The method of claim 19 wherein the first member has a tab that extends over a top surface of the first power connector, and a bottom surface of the third power connector.

22. The method of claim 21 wherein:

the second member contacts the second side wall of the second power connector, and the second side wall of the fourth power connector; and the second member has a tab that extends over a top surface of the second power connector, and a bottom surface of the fourth power connector.

23. The method of claim 19 wherein the first and second members lean towards the top surface of the base region.

24. The method of claim 23 wherein the second member contacts the second side wall of the second power connector, and the second side wall of the fourth power connector.

* * * * *

UNITED STATES PATENT AND TRADEMARK OFFICE

CERTIFICATE OF CORRECTION

PATENT NO. : 7,056,138 B2
APPLICATION NO. : 10/913871
DATED : June 6, 2006
INVENTOR(S) : Lewis et al.

It is certified that error appears in the above-identified patent and that said Letters Patent is hereby corrected as shown below:

Title Page,

Item (54), Line 1, delete "ANDERSON-TYPE".

Title Page,

Item 56, References Cited, OTHER PUBLICATIONS, "Anderson Power Products," reference, delete "Poducts" and replace with --Products--.

Column 1,

Line 1, delete "ANDERSON-TYPE".

Column 3,

Line 49 and 50, delete "41451" and replace with --414S1--

Line 50, delete "41452" and replace with --414S2--.

Signed and Sealed this

Twenty-second Day of August, 2006

JON W. DUDAS
*Director of the United States Patent and Trademark Office*